United States Patent [19]

Howard et al.

[11] 4,074,385

[45] Feb. 21, 1978

[54] CARPET CLEANING BRUSH

[76] Inventors: Lawrence F. Howard, 20599 Barnard Ave., Walnut, Calif. 91789; James W. Mills, 16727 Fellowship, Valinda, Calif. 91744; James L. Shannon, 7914 Greenbush, Van Nuys, Calif. 91402

[21] Appl. No.: 703,086

[22] Filed: July 6, 1976

[51] Int. Cl.[2] ..... A46B 7/08; A47L 11/16

[52] U.S. Cl. ..... 15/180; 15/49 R

[58] Field of Search ..... 15/28, 29, 49 R, 50 R, 15/49 RB, 50 A, 52, 98, 180, 366, 382, 385, 5; 51/170 T, 177; 114/222

[56] References Cited

U.S. PATENT DOCUMENTS

| | | | |
|---|---|---|---|
| 3,397,419 | 9/1968 | Okun | 15/180 X |
| 3,398,422 | 8/1968 | Barry et al. | 15/50 R X |
| 3,628,489 | 12/1971 | Michaelsen | 15/29 X |

FOREIGN PATENT DOCUMENTS

| | | | |
|---|---|---|---|
| 945,037 | 12/1963 | United Kingdom | 15/49 R |

*Primary Examiner*—Edward L. Roberts
*Attorney, Agent, or Firm*—Lyon & Lyon

[57] ABSTRACT

Disclosed herein is a brush for cleaning carpets which includes a base member by which the brush is secured to the underside of a rotary or oscillating machine to impart a corresponding movement to the brush; a plurality of bundles of bristles, each bundle extending from the underside of the base member and being spaced from adjacent bundles; and a plurality of freely rotatable spheres journaled in the underside of the base member and protruding therefrom to support the weight of the brush and machine and vibrate against the carpet as the brush is driven thereover.

8 Claims, 4 Drawing Figures

FIG. 1
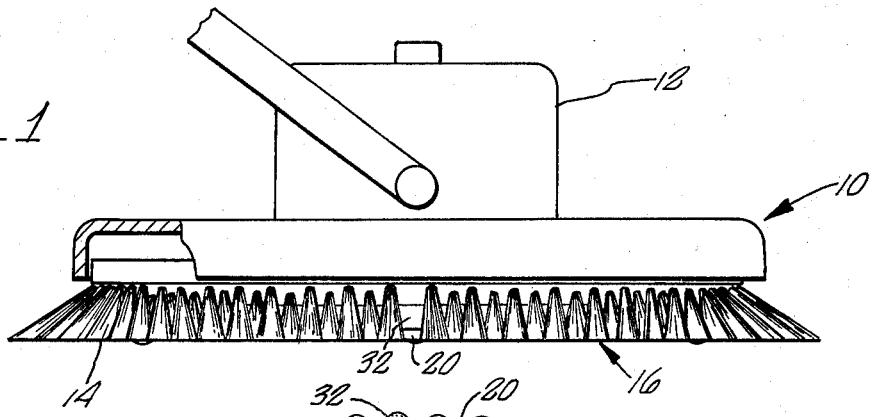
FIG. 3
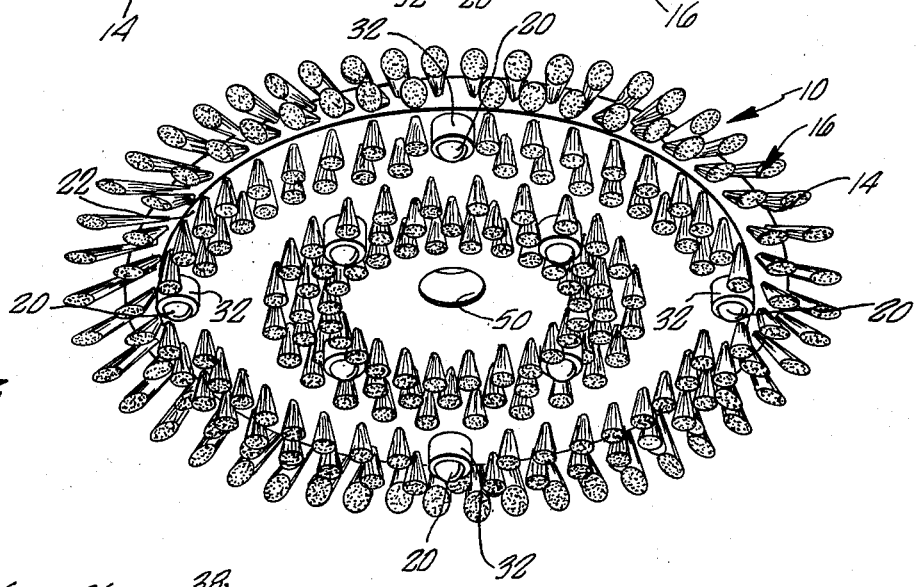
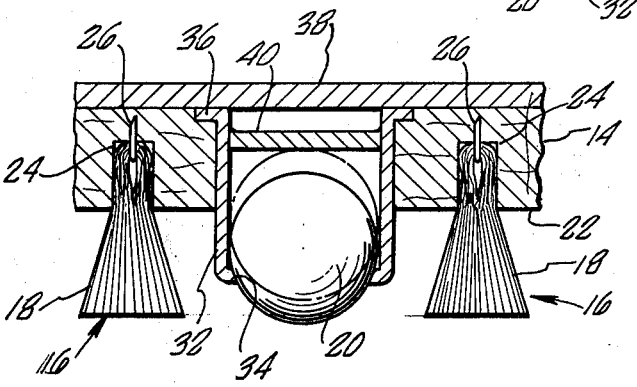
FIG. 2
FIG. 4
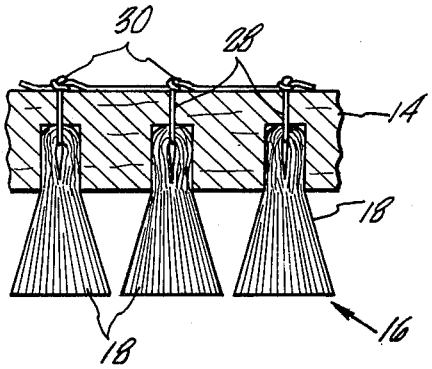

CARPET CLEANING BRUSH

BACKGROUND OF THE INVENTION

Carpet cleaning brushes of the type adapted to be mounted on a rotating or oscillating machine typically comprise a base portion by which the brush is secured to the underside of the machine and a large number of closely packet fibers or bristles which extend vertically from the base to scrub the carpet. In addition to constituting the scrubbing element of the brush, these bristles also must support the weight of the brush and the rotating or oscillating driving machine. Despite the closely packed configuration of these bristles, the combination of the machine weight and the movement of the brush causes the bristles to lay over on their sides so that the scrubbing action is actually no more than a wiping of the sides of the bristles over the carpet filaments, which have also been layed down due to the weight and movement of the brush. In this position, the carpet fibers cannot be thoroughly cleaned and the carpet matting is shielded from the scrubbing action of the bristles, preventing any dirt or other foreign matter thereon from being dislodged. This problem is particularly acute with the use of rotary-type machines, wherein the carpet is continually pressed down in a given direction. However, even with the use of oscillating equipment, the construction of the brush sufficiently compacts the carpet fibers such that neither they nor the carpet can be thoroughly cleaned.

While several different methods have been developed for cleaning carpets, such as wet shampoo, steam and dry foam, most all of these methods utilizes in at least one step thereof the scrubbing of the carpet with a power driven brush. If the brush overly compresses the carpet fibers, as described above, the cleaning process is necessarily impeded. To avoid this problem, the brush should ideally be constructed in such a manner that it tends to raise the carpet pile as opposed to flattening the pile, as lifting of the pile could not only expose all sides of the fibers to the scrubbing action of the brush's bristles, but additionally exposes the carpet backing so that any foreign matter accumulating thereon could be removed. To facilitate removal of such matter, it would ideally be desirable to provide the brush with a beating action of such a nature that when combined with the scrubbing movement of the brush's bristles a kneading effect on the carpet fibers is created. Such a scrubbing of the fibers would produce a far superior cleaning of the carpet and thereby greatly enhance any carpet cleaning process.

SUMMARY OF THE INVENTION

Briefly, the invention comprises a carpet cleaning brush which is adapted to be secured to either an oscillating or rotary driven mechanism such as a standard buffing machine. The brush includes a plurality of bundles of bristles which are spaced from one another and a plurality of beater balls which are freely rotatable and extend from the underside of the brush. When the brush is rotated or oscillated, the weight of the machine is carried by the beater balls allowing the groups of bristles to raise and scrub the carpet pile, while the beater balls are caused to undergo repeated vertical oscillatory movement causing a beating and rolling action on the carpet. The combination of the scrubbing and brushing exerted by the bristles and the beating and rolling of the beater balls result in a deep thorough cleaning of the carpet.

It is the principal object of the present invention to provide a carpet cleaning brush which is superior to those heretofore available.

It is another object of the present invention to provide a carpet cleaning brush which raises the carpet pile during cleaning thereof.

It is yet another object of the present invention to provide a carpet cleaning brush which maintains the scrubbing bristles in a substantially vertical disposition during cleaning of the carpet.

It is still another object of the present invention to provide a carpet cleaning brush which exerts a kneading and beating action on the carpet during the cleaning thereof.

It is yet another object of the present invention to provide a carpet cleaning brush which exposes the carpet backing to the scrubbing action of the bristles.

These and other objects and advantages of the present invention will become apparent from the following detailed description taken in conjunction with the accompanying drawings.

BRIEF DESCRIPTION OF THE DRAWINGS

FIG. 1 is a side view of the carpet cleaning brush mounted on a standard buffing machine.

FIG. 2 is an enlarged partial sectional view illustrating one of the beater balls and the method of securing the groups of bristles to the brush.

FIG. 3 is an isometric view showing the underside of the brush.

FIG. 4 is an enlarged partial sectional view illustrating a second method of securing the bundles of bristles to the brush.

DESCRIPTION OF THE PREFERRED EMBODIMENT

Referring now in detail to the drawings, the carpet cleaning brush 10, as shown in FIG. 1, is secured to the underside of a conventional buffing machine 12. While a conventional buffing machine is of the rotary type, it is to be understood that the brush 10 can also be used with an oscillating type machine. The brush is comprised of a base member 14, a plurality of groups of bundles 16 of bristles 18 and a plurality of beater balls 20. The bundles of bristles extended vertically about 2.54 cm. (1 inch) from the underside 22 of the base member of the brush and in the preferred embodiment of the brush are spaced about 1.27 to 2.5 cm. (0.5 to 1 inch) from adjacent bundles in a plurality of concentric circles. With larger brushes, such as that shown in FIG. 3, two outer and three inner circles or rings of bundles have been found to be particularly effective and with smaller brushes (not shown) three concentric circles or rings of bundles are preferably employed.

The bristles 18, which comprise an individual bundle 16, are constructed of a natural or synthetic fiber such as nylon, and within an individual bundle, are tightly packed. One method of construction of a bundle of bristles is illustrated in FIG. 2. As seen therein, a channel 24 is drilled or otherwise formed in the underside of the base member and a plurality of bristles are compactly bent about a staple 26, which is forced into the base member at the base of the channel. Typically, a single bundle comprises about 50 filaments or bristles to provide about 100 filament ends. The thickness of the individual bristles depends upon the type of carpet upon which the brush is to be used, with the average being about 18 mil. in diameter. If the brush is specifically designed for use on a low profile carpet, such as indoor-outdoor carpet, the stiffness should be increased to about 22 mil. bristles and conversely, if the brush were to be used on shag carpet, bristles in the nature of 16 to 18 mil. would be ideally employed. It should also be noted that the outermost bundles of bristles can be extended angularly from the base member 14 so that they protrude from the perimeter portion thereof to facilitate cleaning adjacent walls and the like.

While the method of constructing the bundles of bristles illustrated in FIG. 2 and described above is preferable in that it can be carried out mechanically, a second method is illustrated in FIG. 4, which would be employed if a metal base were being used or for other reasons such as tooling, the bundles had to be constructed by hand. In such construction, the individual filaments are secured by a wire loop 28, which extends through the base member, if twisted at 20 to secure the bundle within the drilled channel, subsequently extended at both ends to similarly tie and secure the adjacent bundles of bristles. It should be noted that the outer or perimeter bundles are inclined at a greater angle than the remaining bundles to extend from the edge of the brush into corners and the bases of walls and the like.

The beater balls 20, which are preferably constructed of nylon, to provide a smooth rolling surface, are disposed among the concentric rings of bristles 16 in circular holders 32. The lower ends 34 of the holders are tapered inwardly to secure the ball therein. The upper end of the holder is preferably provided with a collar portion 36, which is disposed in a recessed area in the upper surface of the base member 14. A back plate 38 is then disposed over the base member thereby securing the holders in place.

A spacer 40 is secured within the holder and preferably positioned such that the beater ball is free to undergo vertical movement between the spacer and tapered end of the holder of about 0.3 to 0.635 cm. (0.125 to 0.25 inches) above the ends of the bristles depending on the initial relative extensions of each.

In use, the brush 10 is secured to the underside of the buffing machine 12 or other rotating or oscillating machine via a conventional fastening means (not shown), which extends through a central aperture 50 in the base member of 14. So positioned, the weight of the brush and machine are carried by the beater balls 20 thereby allowing the bristles to be disposed between the carpet fibers in a substantially vertical disposition. As rotating or oscillating movement is imparted to the brush, the bristles work around and between the carpet filaments, thereby tending to raise the carpet pile or filaments and scrub all sides thereof, as well as the carpet backing from which the filament extends. Additionally, vibration is imparted to the brush 10 by the driving mechanism causing alternate loading and unloading of the individual beater balls 20 within their holders 32. This oscillatory or beating action of the balls combined with the rolling motion thereof over the carpet filaments, which occurs as the brush is moved thereover and the scrubbing of the plurality of bundles of bristles causes a kneading and beating effect on the carpet which, when used with a suitable cleaning agent, results in a deep cleaning action capable of removing deep and normally uncleanable soiled areas. In addition, the rolling surface provided by the beater ball reduces the drag as the brush is moved over the carpet thereby prolonging the life of the brush, allowing brushes of larger diameter to be used without overloading the driving equipment and reducing operator strain which when coupled with the more efficient cleaning action results in an appreciable savings of manhours as well as a superior cleaning.

Various changes and modifications may be made in carrying out the present invention without departing from the spirit and scope thereof. Insofar as these changes and modifications are within the purview of the appended claims, they are to be considered as part of the present invention.

We claim:

1. A brush for cleaning carpet comprising a base member; a plurality of bundles of bristles disposed about and extending from the underside of said base member, each of said bundles being spaced from the bundles adjacent thereto; and means carried by the underside of said base member for supporting said brush, said means being (mounted for) vertically moveable with respect to said base such that said means undergoes vertical oscillatory motion in response to vibration of said base member.

2. A brush for cleaning carpet comprising a base member; a plurality of bundles of bristles disposed about and extending from the underside of said base member, each of said bundles being spaced from the bundles adjacent thereto; a plurality of spherical members; and mounting means for mounting said spherical members upon the underside of said base member, said mounting means including means permitting both rotational and vertical movement of said spherical members therein.

3. The combination of claim 2 wherein said mounting means includes means for confining said spherical members therein and means for limiting the vertical movement of said spherical members within said mounting means from about 0.3 to 0.7 cm.

4. The combination of claim 3 wherein said spherical members are free to oscillate within said mounting means from about 0.64 cm. above the ends of said bristles to about 0.32 cm. below the ends of said bristles.

5. The combination of claim 2 wherein said plurality of bundles of bristles are disposed about the underside of said base member in a plurality of concentric circles.

6. The combination of claim 5 wherein said mounting means are disposed along one or more of said concentric circles defined by said plurality of bundles of bristles.

7. The combination of claim 6 wherein each of said bundles of bristles is substantially uniformly spaced from bundles of bristles adjacent thereto by about 1.2 to 2.6 cm.

8. The combination of claim 2 wherein the outermost bundles of bristles extend angularly from said base member and protrude from the perimeter portion thereof.

* * * * *